US007896943B2

(12) United States Patent
Witschen et al.

(10) Patent No.: US 7,896,943 B2
(45) Date of Patent: Mar. 1, 2011

(54) FRUSTUM-SHAPED INSULATION FOR A POLLUTION CONTROL DEVICE

(75) Inventors: Steven P. Witschen, Greensboro, NC (US); Jacen W. Busick, Randleman, NC (US); Robin Richter, Hilbersdorf (DE)

(73) Assignees: BGF Industries, Inc., Greensboro, NC (US); Belchem Fiber Materials GmbH, Freidberg (DE)

( * ) Notice: Subject to any disclaimer, the term of this patent is extended or adjusted under 35 U.S.C. 154(b) by 364 days.

(21) Appl. No.: 12/027,602

(22) Filed: Feb. 7, 2008

(65) Prior Publication Data

US 2009/0199521 A1 Aug. 13, 2009

(51) Int. Cl.
*B01D 46/00* (2006.01)

(52) U.S. Cl. ..... 55/523; 55/527; 55/DIG. 30; 428/221

(58) Field of Classification Search ..... 55/522, 55/524, 523, 527, 528, DIG. 30, 385.3, 521, 55/529; 95/47; 422/168, 178, 177, 179, 422/180; 501/35, 36; 216/97; 428/359, 428/362, 221; 123/198 E
See application file for complete search history.

(56) References Cited

U.S. PATENT DOCUMENTS

| | | | | |
|---|---|---|---|---|
| 3,598,157 | A | 8/1971 | Farr et al. | |
| 3,732,894 | A | 5/1973 | Botsolas | |
| 4,431,449 | A | 2/1984 | Dillon et al. | |
| 4,693,338 | A | 9/1987 | Clerc | |
| 4,778,499 | A * | 10/1988 | Beaver | 65/390 |
| 4,853,001 | A * | 8/1989 | Hammel | 95/47 |
| 4,999,168 | A | 3/1991 | Ten Eyck | |
| 5,043,045 | A * | 8/1991 | Chassagneux et al. | 216/99 |
| 5,567,516 | A * | 10/1996 | Achtsnit | 428/357 |
| 5,609,934 | A | 3/1997 | Fay | |
| 5,972,500 | A * | 10/1999 | Gross et al. | 428/370 |
| 6,001,437 | A * | 12/1999 | Thorpe et al. | 428/34.5 |
| 6,468,932 | B1 | 10/2002 | Robin et al. | |
| 6,923,942 | B1 | 8/2005 | Shirk et al. | |
| 2007/0065349 | A1 | 3/2007 | Merry | |

FOREIGN PATENT DOCUMENTS

| | | |
|---|---|---|
| DE | 2300982 | 7/1974 |
| DE | 2314465 | 10/1974 |
| DE | 2549255 | 5/1977 |
| DE | 3432283 | 3/1986 |
| DE | 3626728 | 2/1988 |
| DE | 3700070 | 7/1988 |

(Continued)

OTHER PUBLICATIONS

International Search Report and Written Opinion (PCT/US09/32105) issued Mar. 27, 2009.

*Primary Examiner* — Duane Smith
*Assistant Examiner* — Minh-Chau Pham
(74) *Attorney, Agent, or Firm* — Womble Carlyle Sandridge & Rice, PLLC

(57) ABSTRACT

A preformed insulation mat is provided for use between the inner and outer end cone housing of a pollution control device. The preformed insulation includes a frustum-shaped mat. The mat is formed of primarily heat moldable, silica based glass fibers containing $Al_2O_3$ and is molded at a selected temperature and for a selected time duration to heat set the fibers, whereby the frustum-shaped mat is seamless and self-supporting, requiring no shape no shape retaining elements or chemical binders.

15 Claims, 3 Drawing Sheets

FOREIGN PATENT DOCUMENTS

| | | |
|---|---|---|
| DE | 3830352 | 11/1989 |
| DE | 3835841 | 4/1990 |
| EP | 0413998 | 2/1991 |
| EP | 0643204 | 3/1995 |
| EP | 0692616 | 1/1996 |
| EP | 0573834 | 4/1996 |
| FR | 9303533 | 9/1994 |
| GB | 1488649 | 2/1974 |
| GB | 2143902 | 2/1985 |
| JP | SHO61-89916 | 5/1986 |
| JP | HEI 2-61313 | 3/1990 |
| WO | WO9119081 | 12/1991 |

* cited by examiner

FRUSTUM-SHAPED INSULATION FOR A POLLUTION CONTROL DEVICE

FIELD OF THE INVENTION

The present invention relates generally to insulating materials for high temperature applications, and, more particularly, to a preformed frustum-shaped insulation for use in a pollution control device such as a catalytic converter.

BACKGROUND OF THE INVENTION

Pollution control devices such as catalytic converters and other exhaust gas devices are well known and conventionally used to filter and/or purify the exhaust gases produced by internal combustion engines. Because these devices are subjected to relatively high temperatures during operation, it is necessary that they be sufficiently insulated to limit heat dissipation and/or damage to nearby components.

The most common of these devices include a filtration housing having inlet and outlet connections, with the inlet and outlet connections typically being formed as frusto-conical-shaped assemblies that are double-walled and have an insulating material, in mat form, installed between the two walls. The insulating material must be formed of a material that can withstand the anticipated high operating temperatures and repeated thermal cycles of heatup and cool down without physically or chemically degrading.

Heretofore, the insulating materials used in these pollution control devices have been produced in several ways: (1) they have been formed into insulating mats from slurries of inorganic materials; (2) flat sheets of high temperature resistant insulating material have been die cut to approximate shapes and crudely stuffed into double-walled inlet and outlet assemblies, or (3) flat sheets of materials have been cut and preformed into a desired freestanding shape. In the latter case, retaining elements such as tapes or films are necessary to maintain the preformed shape of the insulation prior to installation. Alternatively, chemical binders such as adhesive mixtures are added to the sheet material so that the insulation will retain a freestanding, preformed shape after an appropriate heat or curing treatment. Each of these prior techniques, however, suffer from one or more of the difficulties of handling and forming, poor fit and/or buckling of the insulation when installed, and/or high materials costs where retaining elements, binders, and the like must be employed during the manufacturing process. Also, organic binders degrade or heat up creating outgassing and concerns for health and safety.

SUMMARY OF THE INVENTION

An aspect of the present invention is directed to an easily preformed, and more economically manufactured frustum-shaped insulation for use between the inner and outer end cone housing of a pollution control device, such as a catalytic converter. As such, the insulation is formed from a relatively flat mat containing, primarily heat moldable, silica based glass fibers containing a minor amount of $Al_2O_3$ (0.1-20%). Surprisingly, these silica based fibers have been found suitable for direct molding, because under certain time and temperature conditions, they can be shaped and molded into freestanding insulation cones, without requiring any additional processing steps such as binding, coating, taping, sealing, seaming, etc. Rather, no additional materials, retainers, or structural features are necessary to form the high temperature resistant frustum-shaped insulation of the present invention.

More particularly, in one embodiment the mat is initially formed with a substantially centrally formed opening that is dimensioned to fit around the diameter of the inlet or outlet openings of the pollution control device. The mat of glass fibers is subsequently permanently molded at a selected temperature and for a selected time duration to heat set the fibers of the mat into a substantially frustum-shaped insulation mat.

Another aspect of the present invention is directed to an exhaust emission control device. In one embodiment, the device includes a housing having an inlet end cone assembly and an outlet end cone assembly. Each end cone assembly has an inner cone housing and an outer cone housing. A preformed insulating cone as described above is installed between the inner and outer cone housing of each end cone assembly to provide a better fitting insulation mat.

Yet another aspect of the present invention is directed to a method for forming the preformed insulation that is described above. According to one exemplary process, this includes a first step of forming a relatively flat fibrous mat of the silica based fibers described above, placing the mat into a substantially frustum-shaped mold, the mold comprising inner and outer cone-shaped housing sections. The mat and mold are then subjected to a selected temperature for a selected time duration, as described in greater detail below, that is sufficient to heat set the glass fibers within the non-woven mat. The sandwiched mat is thus permanently molded into a substantially frustum-shaped insulation, yet remains sufficiently flexible so that installation into the inlet and outlet cones of the exhaust emission control device can be easily accomplished.

These and other features and aspects of the invention will become more apparent upon review of the detailed description set forth below when taken in conjunction with the accompanying drawing figures, which are briefly described as follows.

DESCRIPTION OF THE PREFERRED EMBODIMENTS

Definitions

"Cone" refers to any geometric shape whose base is generally rounded and which has a side or surface that tapers upwardly and inwardly. As used herein, "cone" encompasses geometric shapes having either circular, oval, oblong, or elliptical base shapes.

"Frustum" refers to a part of a generally conical shape that remains after cutting off a top portion with a plane that is substantially parallel to the base of the solid. As used herein, frustum may be used interchangeably with "frusto-conical" when referring to the frustum of a cone, as defined above.

Figure 1:
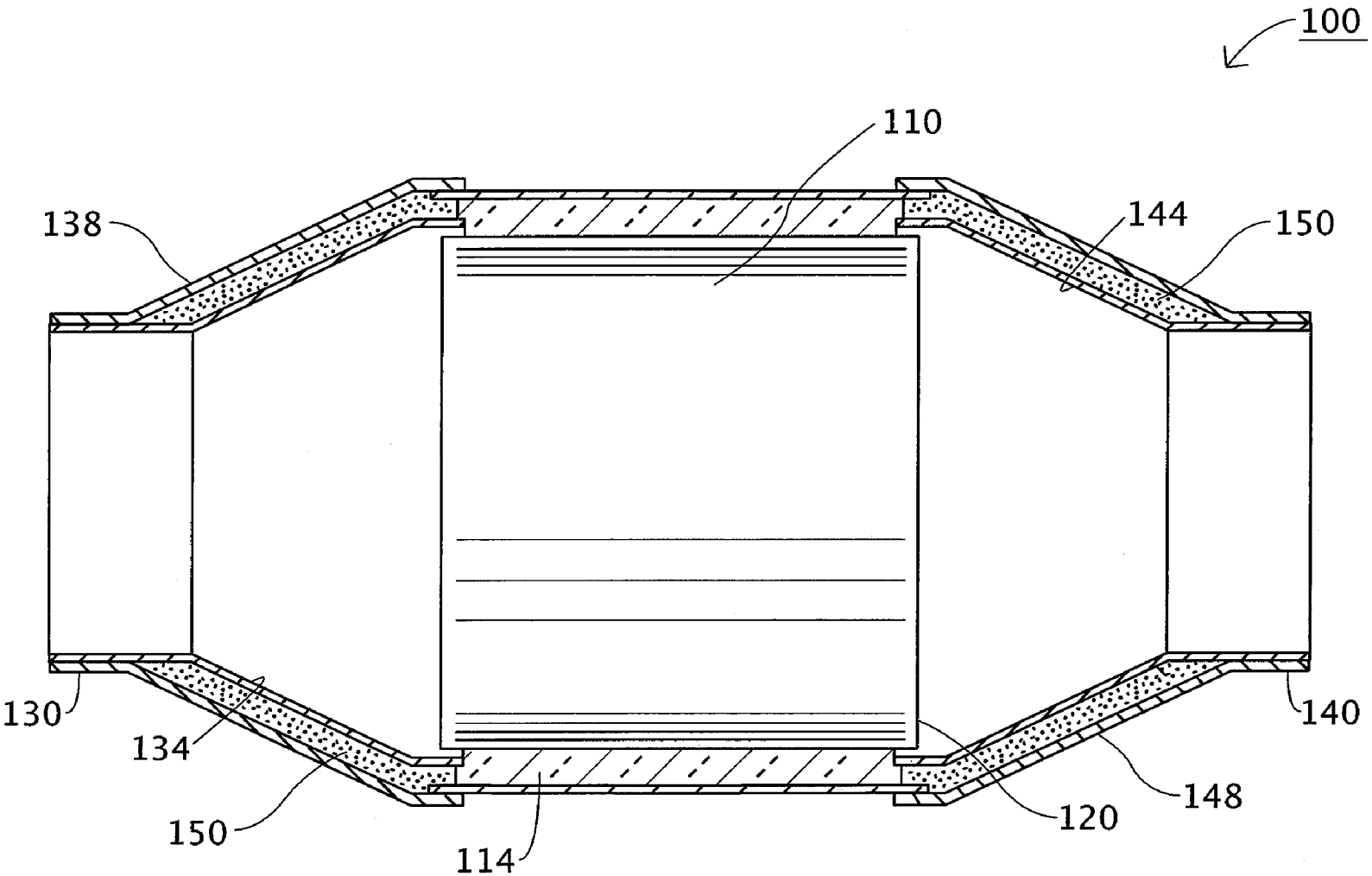
FIG. 1 is a cross-sectional view of a catalytic converter having inner and outer end cone housings with a preformed insulator installed between the double walls.

Referring now in more detail to the Figures, and first to FIG. 1, a typical (prior art) pollution control device, such as a catalytic converter, is shown generally as 100. The pollution control device 100 comprises a generally cylindrical housing 120, or can, having generally frusto-conical inlet 130 and outlet 140 cone assemblies affixed at opposing open ends. The housing, which is typically formed of a metal such as stainless steel, houses a catalytic element 110 for filtering the high temperature gaseous exhausts from an internal combustion engine, for example. To confine the heat of the high temperature gases, an insulating material, such as a mat 114, is typically wrapped around the cylindrical housing.

The inlet 130 and outlet 140 end cone assemblies provide the interconnection between the housing of the catalytic converter and the internal combustion engine on the inlet end and the discharge manifold on the outlet end. Each of the inlet and outlet end cone assemblies 130, 140 respectively further comprises inner housing sections 134, 144 and outer housing sections 138, 148. Disposed between the inner and outer housings of the cone assemblies 130, 140 is one embodiment of the preformed insulation 150 of the present invention. Installed in this manner, the preformed insulation protects other components proximate the catalytic converter 100 against damage or other adverse or harsh environmental effects which could be caused by the relatively high temperatures of the exhaust gases.

Figure 2:
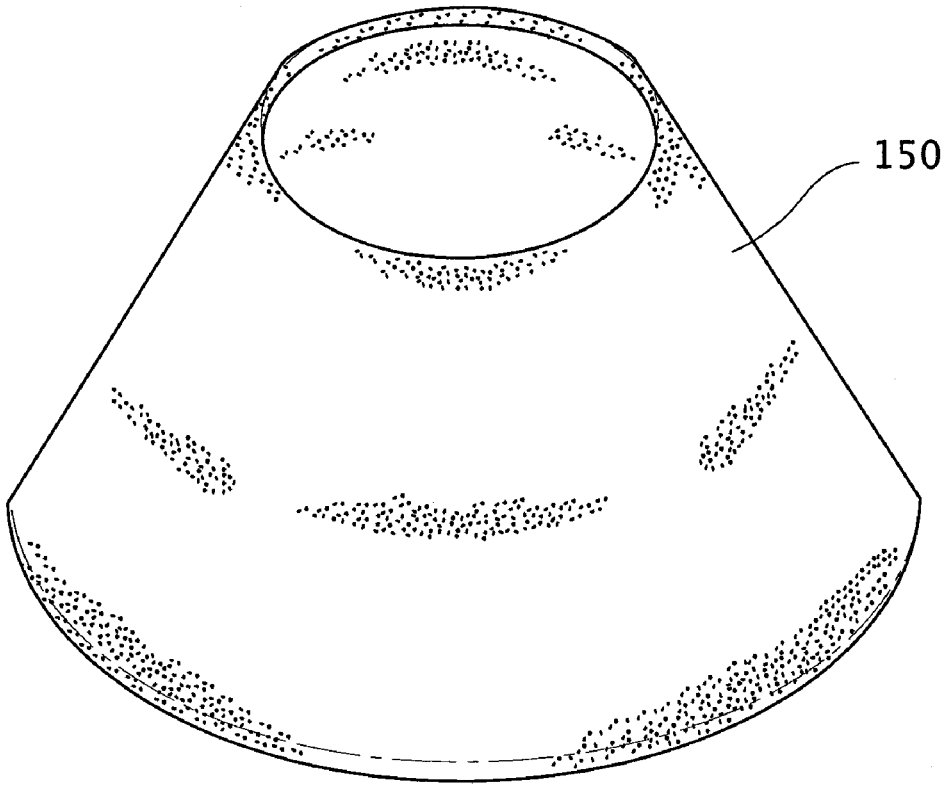
FIG. 2 is a side perspective view of one embodiment of a frusto-conically shaped preformed insulator formed according to the present invention.
Figure 2A:
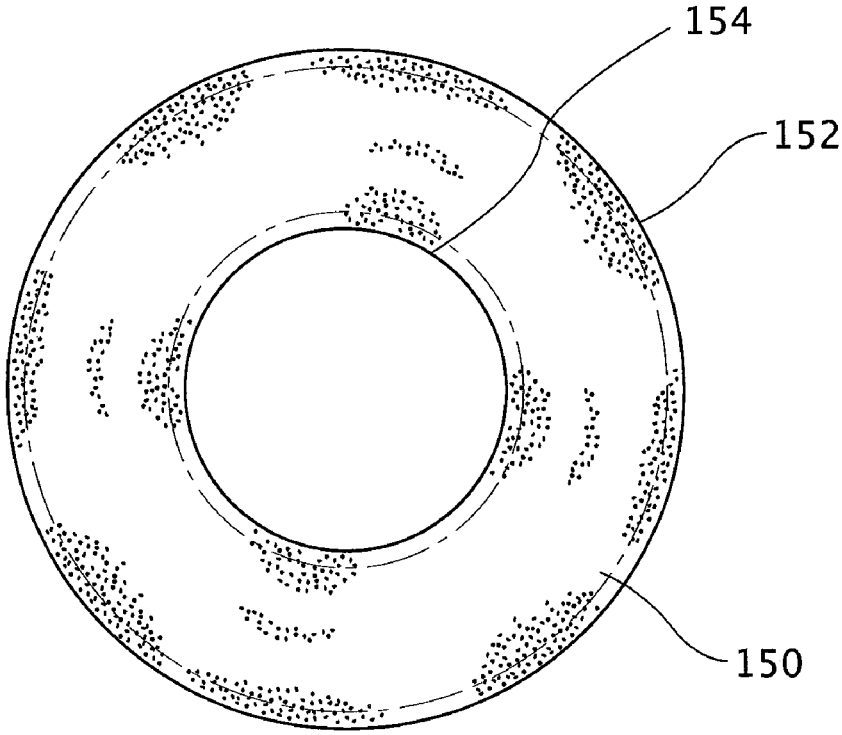
FIG. 2A is a plan view of the embodiment of FIG. 2.

Turning now to FIGS. 2 and 2A, one embodiment of the preformed insulation 150 is shown and will be described in detail. As shown, this embodiment of the preformed insulation is a freestanding frusto-conical insulation having a substantially circular open base 152 and a centrally formed circular open top 154. As those skilled in the art will appreciate, the relative dimensions, including thickness, of the preformed insulation are variable, and thus not important to the invention. Unlike the prior art insulating mats attempted for the same application, the preformed insulation of the present invention has a continuous surface area; i.e., no grooves, slits, or seams.

The method of producing the preformed frustum-shaped insulation begins with a non-woven mat of fibrous textile material. It has been found that a non-woven mat suitable for producing the desired preformed insulation may be formed from high temperature-resistant glass fibers having textile-like properties. One such fiber is a heat stable, silica-based fiber containing a minor amount of $Al_2O_3$ (0.1-20%). This fiber is described in detail in U.S. Pat. No. 6,468,932 to Richter et al., the content of which is incorporated herein in its entirety. These fibers are characterized as open, highly voluminous, and bulky, as those terms are defined in the textile arts. The inventors have found that staple fibers of material having these characteristics are thus most suitable for forming the primary constituent for a non-woven mat structure. This is due in large part to the resistance of these fibers up to temperatures of about 2000 degrees Fahrenheit, which is within the high temperature ranges (between about 1500 degrees Fahrenheit and 2000 degrees Fahrenheit) for the applications contemplated herein. The inventors have also revealed that another property of a silica-based fiber containing some small quantity of $Al_2O_3$ make these fibers particularly suitable for the present applications; i.e., the fibers are sufficiently pliable and moldable when subjected to lower temperatures, making them quite suitable for molding into a preformed shape, yet are heat-stable, meaning that they will not melt at these operating temperatures. Thus, while the fibers are heat-stable and high temperature resistant on one hand, mats of these fibers can be permanently deformed and heat set into a desired shape when subjected to the heat and temperature combinations described below.

In one embodiment, the silica-based glass fibers containing some $Al_2O_3$ used to form the non-woven mat are preferably, but not necessarily, between about 2.5 inches and 3.5 inches in length and have fibers sizes of between about 3.5 and 24 microns with 6-12 microns being preferred. The inventors have also found that forming a mat having fibers with a moisture content of between about 2 and 20% (6-15% being preferred) of water by weight (remaining at the time of the subsequent molding) facilitates the molding of the fibrous non-woven mat.

While other techniques, such as (1) wet-laying and (2) carding and cross-lapping, would be acceptable, in the embodiment being described herein, the fibers are formed into a non-woven mat through air-laying, which is a process whereby fibers are distributed by air currents into a random orientation within the fibrous web/batt. Subsequently, the web is needle punched to a thickness less than about one inch, and typically between about ¼ inch and ⅜ inch for catalytic converter applications. Needle punching is a process wherein hooked needles are systematically punched into the thickness of a web and retracted to entangle the fibers through the thickness of the mat into a coherent, bound structure.

While the examples herein are described as comprising 100% silica-based fibers containing some $Al_2O_3$, the inventors have found that a suitable preformed insulation having the necessary high-temperature resistance can be formed from mats having less than 100% percent of these fibers. Rather, mats having at least about 25% of these fibers in combination with other high heat resistant fibers should operate satisfactorily. Ceramic fibers, basalt fibers, and method fibers are just a few examples. Further possible components in low weight proportions (0-3%), such as $CaO_2$, $TiO_2$, $MgO_2$, $Fe_2O_3$, BaO, PbO, $Cr_2O_3$, and F, may be added as described in the Richter et al. U.S. Pat. No. 6,468,932.

Once the needle-punched non-woven mat is formed, the mat is ready to be die-cut into a desired flat pattern. In the embodiment of FIGS. 2 and 2A, the pattern may be substantially circular, having a centrally formed (concentric) opening that is also circular. In the embodiment shown in FIG. 3, the pattern may be oval or elliptical, but also has a centrally formed circular or elliptical opening. These patterns are merely examples of an unlimited number of possible shapes.

The cut mat pattern is next placed into a mold having sections that are dimensionally similar to the inner and outer housings of the end cone assemblies of the pollution control device 100 described above. As will be appreciated by those skilled in the art, any of a variety of mold shapes and sizes may be utilized to preform an insulation for any particular application. In this embodiment, however, the cut mat is sandwiched between inner and outer mold pieces. The mold may be pre-heated before placing the mat in the mold or heated to the desired temperature after the mat is situated within the mold. In the mold, the mat is pressed to the desired thickness. The following Table I is illustrative of various temperature and dwell time combinations for molding the fibrous mat into a completed self-supporting, preformed insulation mat. The times provided in the table include the time required to pre-heat the mold after placing the mat in the mold. Thus, the actual dwell times at these temperatures would be expected to be somewhat shortened:

TABLE I

| Temperature | Dwell Time | Result (whether self-supporting body is formed) |
|---|---|---|
| 1292° F. | 6 minutes | Acceptable |
| 1112° F. | 1 minute | Unacceptable |
| 1112° F. | 5 minutes | Acceptable |
| 1112° F. | 10 minutes | Acceptable |
| 700° F. | 3 minutes | Unacceptable |
| 700° F. | 15 minutes | Acceptable |
| 700° F. | 60 minutes | Acceptable |
| 700° F. | 120 minutes | Acceptable |
| 600° F. | 60 minutes | Acceptable |
| 500° F. | 60 minutes | Acceptable |
| 400° F. | 60 minutes | Acceptable |

As can be seen from this limited data, there are numerous temperature/time combinations that will provide acceptable results. "Acceptable" in the above table indicates that the cone is self-supporting or retains its shape sufficiently to allow handling and insulation. For example, at temperatures as low as about 400 degrees Fahrenheit for a dwell/mold of at least about one hour, an acceptable preformed insulation will be produced. The inventors contemplate that temperatures less than 400 degrees Fahrenheit will also provide acceptable preforms if the dwell time is increased. Likewise, at higher temperatures, such as about 1100 degrees Fahrenheit or greater, the dwell times may be significantly reduced to about 10 minutes or less. Temperatures up to 2000 degrees Fahrenheit could be used to minimize the dwell time.

Figure 3:
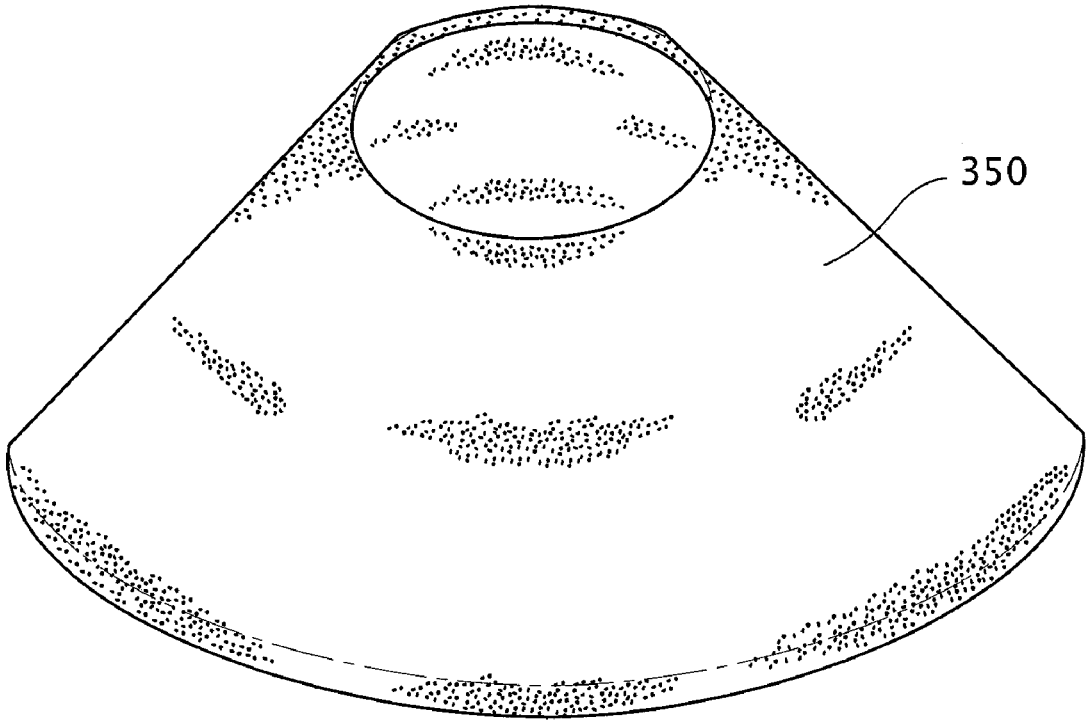
FIG. 3 is a side perspective view of another exemplary embodiment of the shaped preformed insulator formed according to the present invention.
Figure 3A:
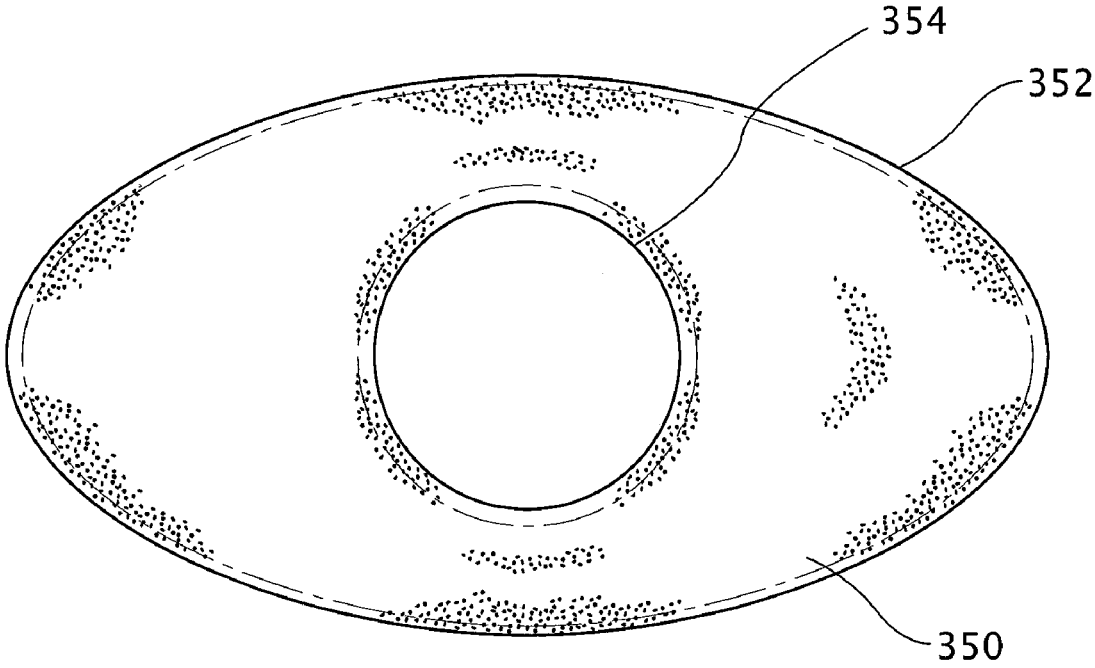
FIG. 3A is a plan view of the embodiment of FIG. 3.

Having already described one embodiment shown in FIGS. 2 and 2A, a second exemplary embodiment is shown in FIGS. 3 and 3A. As shown in these Figures, this preformed insulation is also a freestanding frusto-conical insulation, yet with a substantially elliptical open base 152 and a centrally formed circular open top 154. Again, numerous other frusto-shapes are possible and within the scope of the present invention.

The invention has been described herein in terms of several embodiments and constructions that are considered by the inventors to represent the best mode of carrying out the invention. It will be understood by those skilled in the art that various modifications, variations, changes and additions can be made to the illustrated embodiments without departing from the spirit and scope of the invention. These and other modifications are possible and within the scope of the invention as set forth in the claims.

We claim:

1. A preformed insulation mat for use between the inner and outer end cone housing of an exhaust emission control device, comprising:

(a) a molded frustum-shaped mat having a substantially centrally formed opening;

(b) the mat being binderless and comprising primarily heat moldable, silica based glass fibers containing $Al_2O_3$; and (c) wherein the frustum-shaped mat of glass fibers is molded at a temperature of between about 400 degrees Fahrenheit for about 60 minutes and about 1300 degrees Fahrenheit for about 6 minutes to heat set the fibers whereby the frustum-shaped mat is seamless and self-supporting, requiring no shape retaining elements.

2. The insulation mat of claim 1 wherein the mat comprises:

(a) a non-woven needle-punched web of fibers; and (b) the mat having a continuous outer peripheral edge and the opening having a continuous peripheral edge.

3. The insulation mat of claim 1 wherein the heat moldable, silica based glass fibers contain between 80-99.9% $SiO_2$ and 0.1-20% $Al_2O_3$.

4. The insulation mat of claim 1 wherein the mat is frusto-conical and the base plane is circular.

5. The insulation mat of claim 1 wherein the mat is frusto-conical and the base plane is elliptical.

6. The insulation mat of claim 1 wherein the mat comprises primarily heat moldable, silica based glass fibers containing $Al_2O_3$ and other fibers that can withstand temperatures of up to about 2000 degrees Fahrenheit.

7. A pollution control device, comprising:

(a) a housing having an inlet end cone assembly and an outlet end cone assembly;

(b) each cone assembly comprising an inner cone housing and an outer cone housing;

(c) a preformed insulation mat disposed between the inner and outer cone housing of each end cone assembly and comprising:

(i) a molded frustum-shaped mat having a substantially centrally formed opening;

(ii) the mat being binderless and comprising primarily heat moldable, silica based glass fibers containing $Al_2O_3$; and (iii) wherein the frustum-shaped mat of glass fibers is molded at a temperature of between about 400 degrees Fahrenheit for about 60 minutes and about 1300 degrees Fahrenheit for about 6 minutes to heat set the fibers whereby the frustum-shaped mat is seamless and self-supporting, requiring no shape retaining elements.

8. The pollution control device of claim 7 wherein the $Al_2O_3$-containing, heat moldable, silica based glass fibers contain between 80-99.9% $SiO_2$ and 0.1-20% $Al_2O_3$.

9. The pollution control device of claim 7 wherein the mat is frusto-conical and the base plane is circular.

10. The pollution control device of claim 7 wherein the mat is frusto-conical and the base plane is elliptical.

11. The pollution control device of claim 7 wherein the mat comprises primarily heat moldable, silica based glass fibers and other fibers containing $Al_2O_3$ that can withstand temperatures of up to about 2000 degrees Fahrenheit.

12. A method for forming a frustum-shaped insulation mat for use between the inner and outer end cone housing of a pollution control device, comprising:

(a) forming an annular-shaped fibrous mat of primarily heat moldable, silica based glass fibers containing $Al_2O_3$, and no binders;

(b) placing the fibrous mat into a substantially frustum-shaped mold, the mold comprising inner and outer housing sections, the mat disposed between the inner and outer housing sections;

(c) subjecting the fibrous mat to a temperature of between about 400 degrees Fahrenheit for about 60 minutes and about 1300 degrees Fahrenheit for about 6 minutes to heat set the glass fibers, wherein the mat is permanently molded into a seamless, self-supporting and substantially frustum-shaped insulation, requiring no shape retaining elements.

13. The method of claim 12 wherein the mat is formed from a non-woven needle-punched web of fibers, the mat having a continuous outer peripheral edge and the opening having a continuous inner peripheral edge.

14. The method of claim 13 wherein the heat moldable, silica based glass fibers contain between 80-99.9% $SiO_2$ and $Al_2O_3$ (0.1-20%).

15. The method of claim 14 wherein the fibers comprising the flat fibrous mat initially have a moisture content of between about 2% and about 20%.

* * * * *